US007044175B1

(12) United States Patent
Camejo

(10) Patent No.: US 7,044,175 B1
(45) Date of Patent: May 16, 2006

(54) WATER COOLER REPLENISHING SYSTEM

(76) Inventor: Esteban Camejo, P.O. Box 126606, Hialeah, FL (US) 33012

( * ) Notice: Subject to any disclaimer, the term of this patent is extended or adjusted under 35 U.S.C. 154(b) by 0 days.

(21) Appl. No.: 11/137,645

(22) Filed: May 25, 2005

(51) Int. Cl.
*B65B 1/04* (2006.01)

(52) U.S. Cl. ..... 141/18; 222/185.1; 222/146.6; 222/464.3

(58) Field of Classification Search ..... 222/146.6, 222/185.1, 464.3; 141/18, 198
See application file for complete search history.

(56) References Cited

U.S. PATENT DOCUMENTS 3,653,413 A * 4/1972 Sheya ..... 141/18
4,030,634 A * 6/1977 Osborn ..... 222/23
5,813,701 A * 9/1998 Noble ..... 285/4
6,209,753 B1 * 4/2001 Ohu ..... 222/146.1

* cited by examiner

*Primary Examiner*—Philippe Derakshani
(74) *Attorney, Agent, or Firm*—Gold & Rizvi P.A.; H. John Rizvi; Glenn E. Gold

(57) ABSTRACT

A water cooler replenishing system which is designed to collect drinking water from a conventional supply bottle and dispense the water into a container, on top of a freestanding water cooler, and be repeatedly refilled. The water cooler replenishing system includes a pump having an inlet port and an outlet port. A water container is also included which is shaped and configured to rest on a freestanding water cooler and receive water for filling the container. A supply tube is provided for collecting water from a conventional supply bottle and the supply tube is connected, by fluid conduit to the inlet port. A filler tube is provided for dispensing water into the water container and the filler tube is connected, by fluid conduit to the outlet port. The pump may be selectively energized to collect water from the supply bottle and dispense the water to fill the container.

4 Claims, 5 Drawing Sheets

WATER COOLER REPLENISHING SYSTEM

BACKGROUND OF THE INVENTION

1. Field of the Invention

The present invention generally relates to freestanding water coolers having inverted conventional supply bottles and more particularly to systems for replenishing the supply of water for the water cooler.

2. Description of the Prior Art

Most modern buildings are served by water systems which include a network of pipes disposed within the walls and floors, such that potable water is available at most locations throughout the building; however, there are circumstances which require the use of freestanding water coolers to serve the need for readily available drinking water. Office buildings or buildings which have been converted to office use, are frequently divided into relatively small spaces to suit the needs of small business operations. It is not uncommon for such an office to install a freestanding water cooler rather than a water fountain of the type which must be connected to the building plumbing system, in order to provide drinking water for employees. In addition, certain industrial sites are located where drinking water is not available through a building plumbing system. Also, some offices and households have opted for bottled water, for drinking, even though potable water service is otherwise available. For a variety of reasons, offices and households install water coolers and subscribe to a service which delivers bottled water, for use with the water coolers.

Typically, the water is delivered in bottles having a five gallon capacity. The bottles are typically formed of plastic having an upper portion with a tapered upwardly extending neck, which includes an opening at the distal end. Water coolers are typically formed with a tapered well at their top, corresponding to the shape of the upper portion of the water bottle and designed to receive it in a stable supporting relation. When the water, in a bottle is consumed, the empty bottle is removed from the well. A replacement supply bottle is opened and inverted as it is placed into the well. The full water bottle is heavy and unwieldy. It must be inverted and placed in the well, after the top has been opened. There is a potential for an accident involving a dropped bottle and also the potential of a water spill, which could damage property or cause a slippery condition of the floor. There is a need for a system which can refill a freestanding water cooler without the necessity of lifting a full bottle and inserting the then open bottle into the well at the top of the water cooler.

SUMMARY OF THE INVENTION

The present invention comprises a system and a process for replenishing a freestanding water cooler, from a full conventional supply bottle without the need for lifting and inserting a full supply bottle. The system of the present invention includes a pump, an inlet port and an outlet port. The inlet port and the outlet port are operably connected to the pump which is configured to be selectively energized for urging water inward from the inlet port and outward through the outlet port. The system includes a water container having a top portion with a first opening for dispensing water and having a bottom portion with a second opening for receiving water into the water container. A plug is provided for selectively closing the opening in the bottom of the container. Means for collecting water from a conventional supply bottle are provided. A supply tube, having distal and proximal ends is provided for collecting water from a conventional supply bottle. A flexible supply hose is provided for connecting the proximal end of the supply tube in fluid communication with the inlet port of the pump, for forming a watertight fluid conduit. The supply hose may be expandable to allow for an extended reach. The supply tube is provided with a first transverse collar which is sized for resting engagement with the opening at the top of a conventional water bottle, to prevent passage of the distal end of the supply tube into the supply bottle and to prevent contact between the distal end of the supply tube and the bottom of the supply bottle. The system also includes means for dispensing water through the second opening and into the water container. A filler tube having distal and proximal ends is provided. The distal end is designed to pass through the second opening in the bottom portion of the water container for delivering water. A flexible filler hose is provided for connecting the outlet port of the pump in fluid communication with the proximal end of the filler tube, for forming a watertight fluid conduit. The filler tube is provided with a second transverse collar which is sized for resting engagement with the periphery of the opening in the bottom of the water container to prevent passage of the proximal end of the filler tube.

In use the water container of the system of the present invention may be inverted and placed in the well at the top of a water cooler, while the water container is empty. The filler tube may be introduced through the opening in the bottom of the water container and the supply tube may be partially submerged in an upright conventional water supply bottle. The pump may be energized to collect and deliver the water, from the conventional supply bottle to the water container of the present invention. In this manner, the water cooler may be replenished with a supply of water without the necessity of lifting and inverting a full bottle of water. When the water container is emptied, the system may be used to replenish the water container, of the present invention, from another supply bottle, without the need for removing the water container from the water cooler.

It is an object of the present invention to provide a water cooler replenishing system which is capable of replenishing the supply of water in a freestanding water cooler.

It is a further object of the present invention to provide a water cooler replenishing system capable of replenishing the supply of water, in a water cooler, without the necessity of lifting or inverting the full water bottle.

It is yet another object of the present invention to provide a water cooler replenishing system capable of replenishing the supply of water in a freestanding water cooler without the necessity of moving a supply water bottle to a location immediately proximate to the water cooler.

BRIEF DESCRIPTION OF THE DRAWINGS

The invention will be further understood, by way of example, with reference to the accompanying drawings, in which.

DETAILED DESCRIPTION OF THE PREFERRED EMBODIMENTS

Shown throughout the drawings, the present invention is generally directed toward a system for replenishing a free-standing water cooler from a supply source. The system of the present invention is capable of transferring water to the water cooler without the necessity of lifting a bottle of water and placing it within the well, at the top of the water cooler.

Figure 1A:
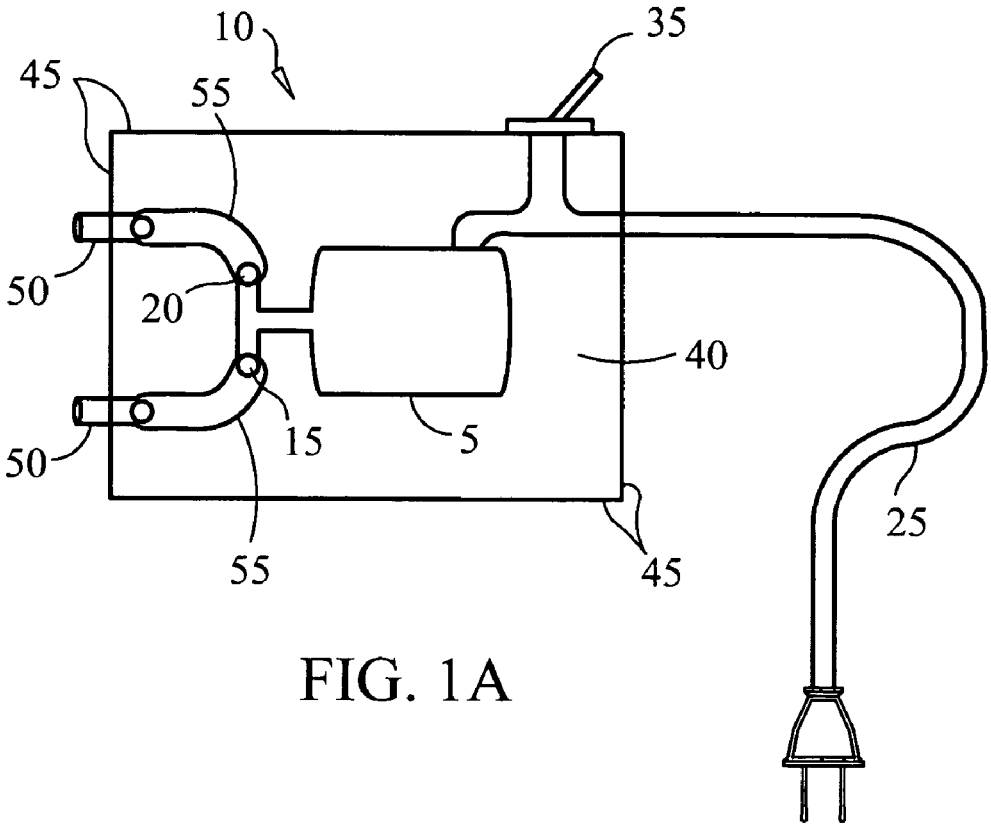
FIG. 1*a* is a plan view of the pump with the housing top removed.
Figure 1B:
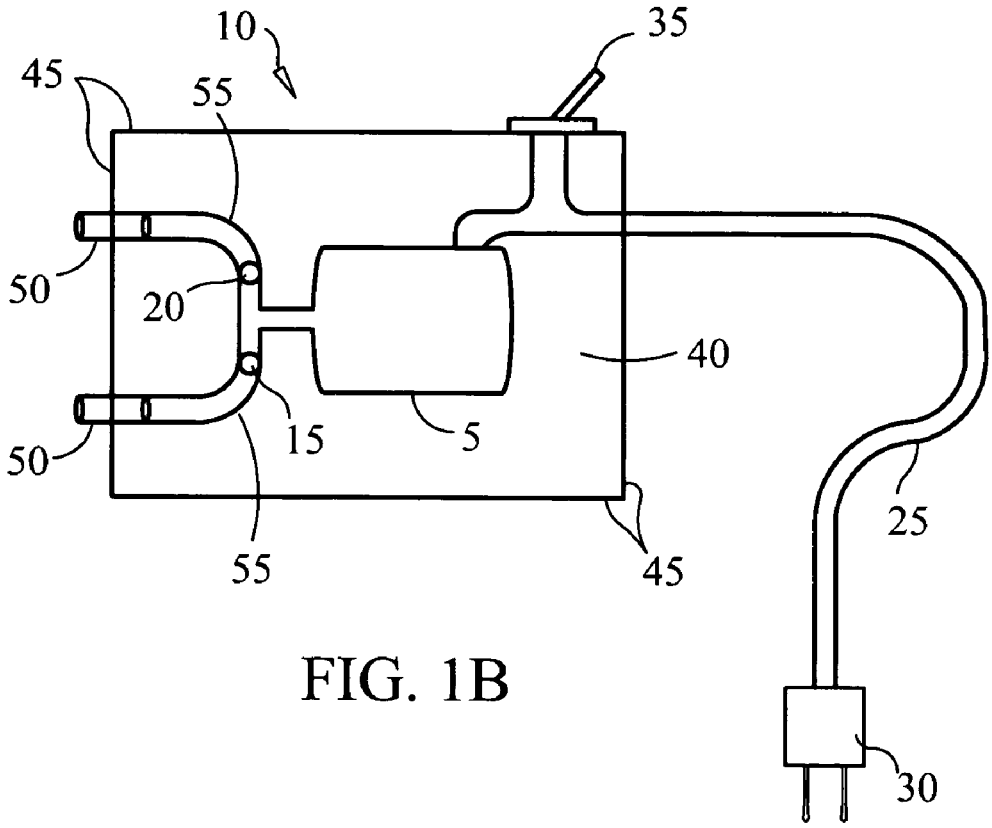
FIG. 1*b* is a plan view of the pump of an alternative version of the present invention, including an adapter and also with the housing top removed.

The system of the present invention includes a fluid pump 5, which for aesthetic and noise reduction purposes, may be disposed within a housing 10, as shown in FIGS. 1*a* and 1*b*. The pump 5, is provided with an inlet port 15 and an outlet port 20, both of which are operably connected to the pump 5 and configured for urging water inward from the inlet port 15 and outward through the outlet port 20. It is preferred that the pump 5 should be electrically powered and have sufficient capacity to transfer five gallons of water within a reasonable period of time. It may be appreciated that the selection of a relatively low capacity pump will reduce the size and weight of the present invention but a greater amount of time will be required to transfer five gallons of water. Commercially available pumps, which are energized by standard 115–120 volt household power, are available in a range of capacities, are suitable for use in the present invention, and may be connected to a standard power outlet, by a power cord 25 as shown in FIG. 1*a*. An alternative version of the invention having the pump 5 configured to operate on direct current is shown in FIG. 1*b*, with an adapter 30, for converting household power to direct current. The alternate version of the present invention may be provided with various power cords (not shown) to allow connection to other sources of electric power, for example marine power supplies or batteries. Means for selectively energizing the pump 5 are preferably provided by a switch 35 wired to control the pump 5.

It is contemplated that the present invention would be assembled in both a portable version and in a version suitable for permanent installation or placement. The portable version would include a relatively low capacity lightweight pump. The system could be moved and stored conveniently; however, a relatively long amount of time would be required to replenish a water cooler. The permanent version would include a relatively large capacity pump which would occupy a larger space, but would replenish the water cooler more quickly.

Figure 4:
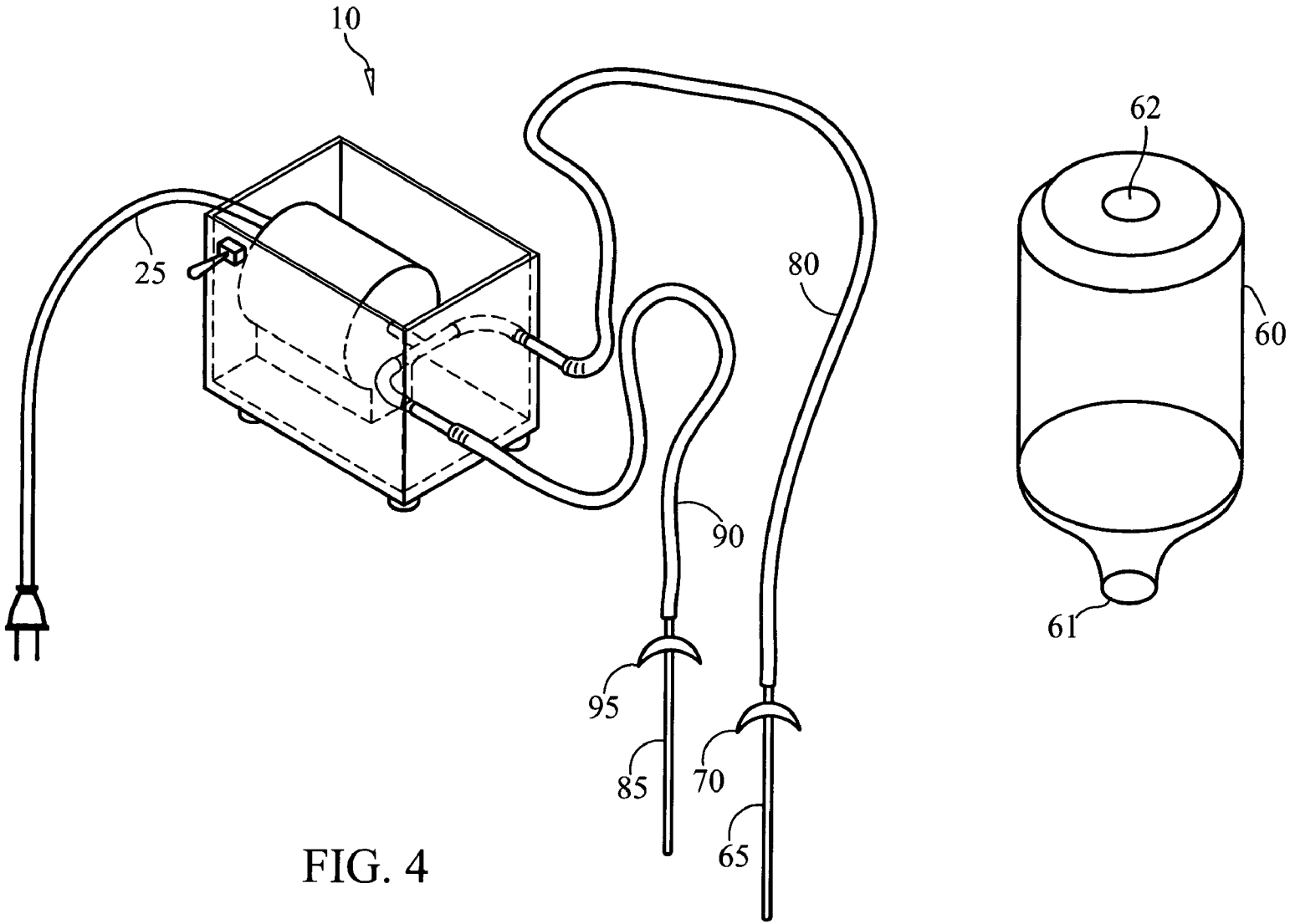
FIG. 4 is a perspective view of the system of the present invention.
Figure 5B:
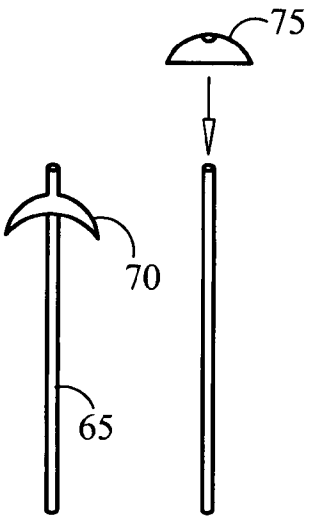
FIG. 5*b* is a perspective view of the supply tube with an integral collar and an alternative tube with a detachable and adjustable collar.
Figure 5A:
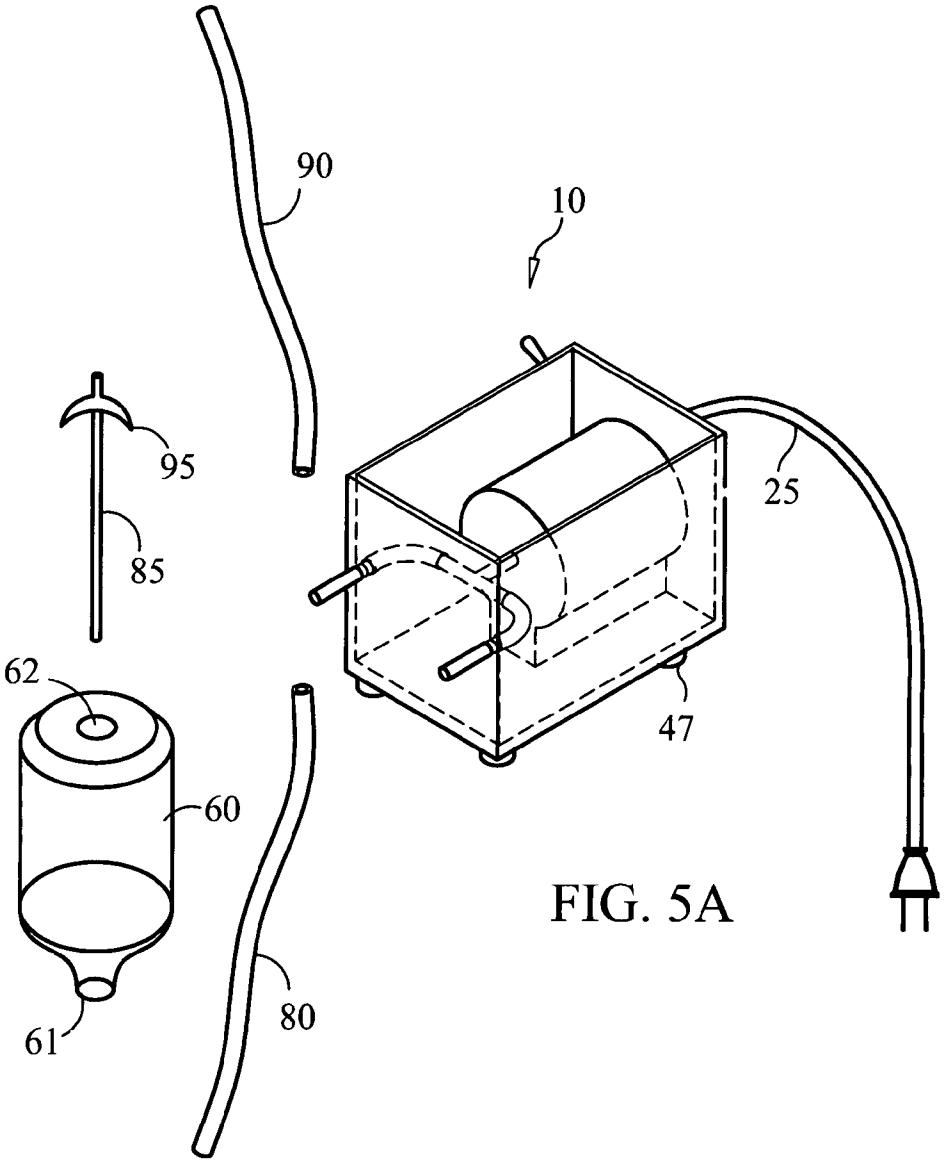
FIG. 5*a* is a perspective view of the system of the present invention with fluid conduits disconnected and shown without a supply tube.

It is preferred that the pump 5 be mounted on a platform 40 formed of a flat rigid sheet of material such as metal or wood. Mounting may be accomplished by conventional means, such as by screws. It is preferred that a housing 10 be provided to conceal the pump 5 from view and to muffle the noise. The housing 10 comprises a plurality of co-joined walls 45, attached to the edges of the platform 40 in generally perpendicular orientation and extending upward from the platform 40 for surrounding the pump 5. The same type of material selected for forming the platform 40 may be used for forming the walls 45. A plurality of feet 47, formed of flexible and resilient material, such as rubber, may be attached to the housing, as shown in FIGS. 4 and 5*a* to dampen vibration from the pump 5.

An aperture is provided in a one of the walls 45 to provide a passage for the power cord 25. An aperture is provided for the wiring of the switch 35 in a like manner, so that the switch 35 may be operated from outside the housing 10.

The inlet port 15 and the outlet port 20 are preferably fitted with extensions each comprising a rigid distal sleeve 50 and a flexible segment 55. Each distal sleeve 50 is preferably formed of metal or plastic and each flexible segment 55 is preferably formed of rubber tubing or plastic tubing. Each distal sleeve 50 is designed to fit snugly within the flexible segment 55 to form a watertight connection providing a fluid conduit. Each flexible segment 55 is sized to connect to the pump 5 by sliding onto one of the inlet port 15 or the outlet port 20 to form watertight connections providing fluid conduits.

A pair of apertures is provided for the extensions so that the inlet port 15 and the outlet port 20 may be accessed from outside the housing. The apertures are lined with throughput fittings to retain the power cord 25, wiring for the switch 35, and extensions in a fixed position within the respective apertures. The housing 10 also includes a top, not shown, which may be designed to fit onto the walls 45 opposite the platform 40, for aesthetic purposes and for noise control.

Figure 2:
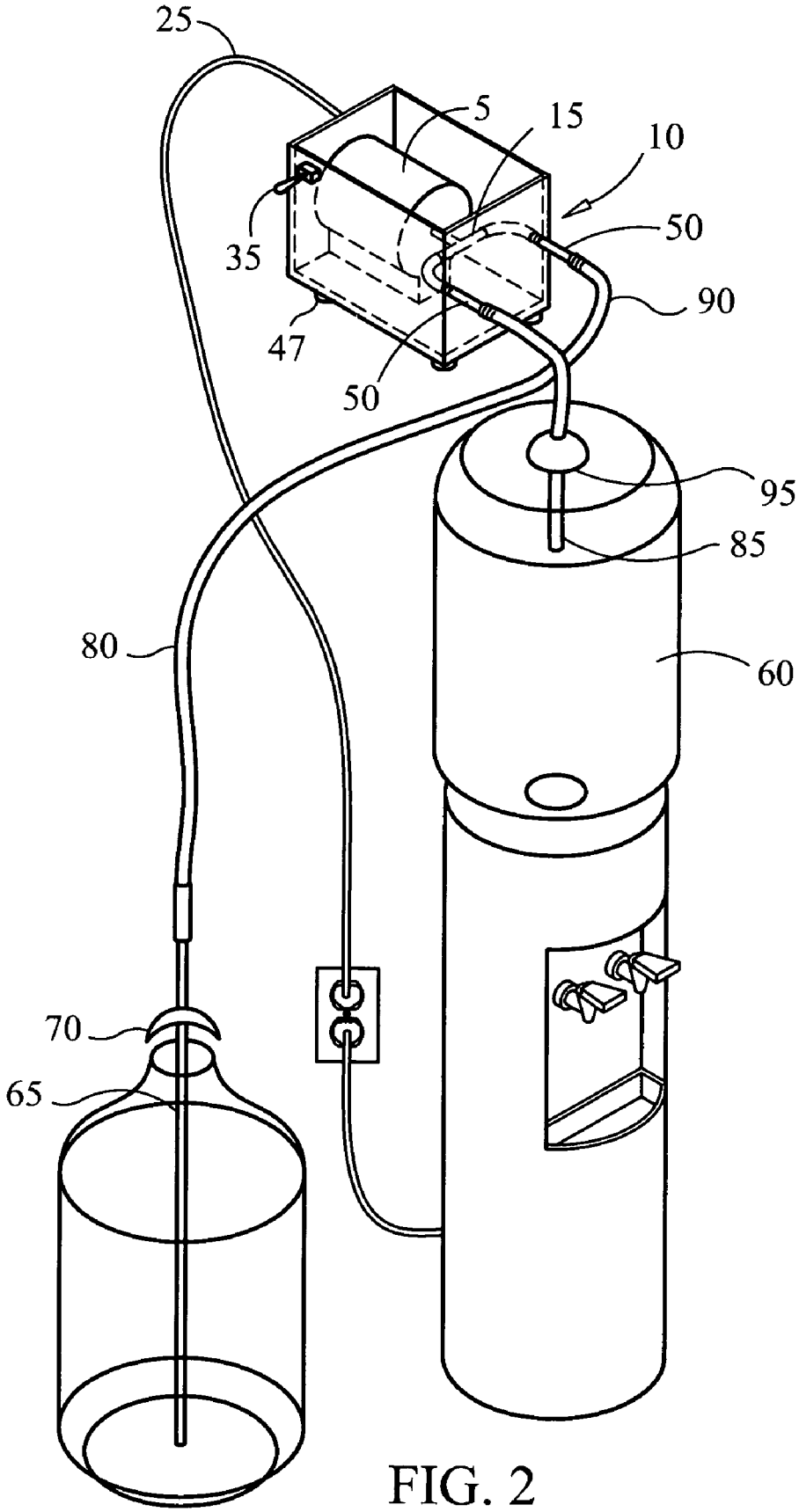
FIG. 2 is a front perspective view of the system of the present invention shown with the pump resting on the inverted water container and with the supply tube in place within a supply bottle.

The system of the present invention is depicted in place with a conventional freestanding water cooler, in FIG. 2. The system includes a rigid water container 60 preferably formed in the size and shape of a conventional water cooler supply bottle and having a top portion and a bottom portion, shown in inverted orientation, in FIG. 4. The top portion has an upwardly extending tapered neck. A first opening 61 is provided at the distal end of the neck, in the manner of a conventional water cooler supply bottle, for feeding water to the water cooler. The bottom portion of the water container 60 is provided with a second opening 62. A plug (not shown) is included for closing the second opening 62 when the system is not in use.

The system includes means for collecting water from a conventional supply bottle. A supply tube 65, shown independently in FIG. 5*a*, is preferably formed of rigid material such as plastic and has a proximal and distal ends. The supply tube 65 has a cross sectional area sufficiently small to pass through the opening of a conventional water cooler supply bottle, as shown in FIG. 2. The supply tube 65 has sufficient length to extend from the bottom of a conventional water cooler supply bottle to a point above the opening, as shown in FIG. 2. The supply tube 65 is preferably provided with a first stop means, such as a transverse collar 70, integral with the supply tube 65 and disposed proximate to the proximal end, as best shown in FIG. 5*a*. The first transverse collar 70 is sized to contact the periphery of the opening at the top of a conventional water cooler supply bottle, when the supply tube 65 is inserted through the opening, as shown in FIG. 2 and positioned to prevent contact between the distal end of the supply tube 65 and the bottom of the bottle. The first stop means also serves to isolate the proximal end of the supply tube 65, which is typically handled manually, from the distal end, which touches the drinking water. In an alternate version of the present invention, the supply tube 65, may be formed without an integral transverse collar and an adjustable collar 75 may be included. The adjustable collar 75, is formed of flexible material, such as rubber and is provided with a central aperture matching the size of the outside circumference of the supply tube 65, such that the adjustable collar 75, may be forced onto an end of the supply tube 65 and moved to any position along the length of the supply tube 65 where it will be retained in position by frictional engagement between the adjustable collar 75 and the supply tube 65. The position of the adjustable collar 75 may be selected so as to position the distal end of the supply tube 65 with respect to the bottom of the bottle. A flexible supply hose 80 is included, which is preferably formed of plastic tubing of conventional manufacture and sized to receive the distal sleeve 50 on the extension from the inlet port 15, within one end and the proximal end of the supply tube 65 within the other end, so as to form a watertight conduit from the supply tube 65 to the inlet port 15, as shown in FIGS. 2 and 4.

The system includes means for dispensing water through the second opening 62 and into the water container 60. A filler tube 85 and a filler hose 90, which may be formed in the same manner as the supply tube 65 and the supply hose 80, are provided. The filler tube 85 being designed to have a cross sectional area sufficiently small to pass through the second opening 62 and being preferably of a shorter length so as to extend within the water container 60, only so far as necessary for dispensing water through the second opening 62. The filler tube 85 is preferably provided a second stop means such as a second transverse collar 95, integral with the filler tube 85, sized to contact the periphery of the second opening 62, and designed to retain the distal end of the filler tube 85 within the water container 60. The second stop means also serves to isolate the portion of the apparatus which is typically handled from that which touches the water.

Figure 3:
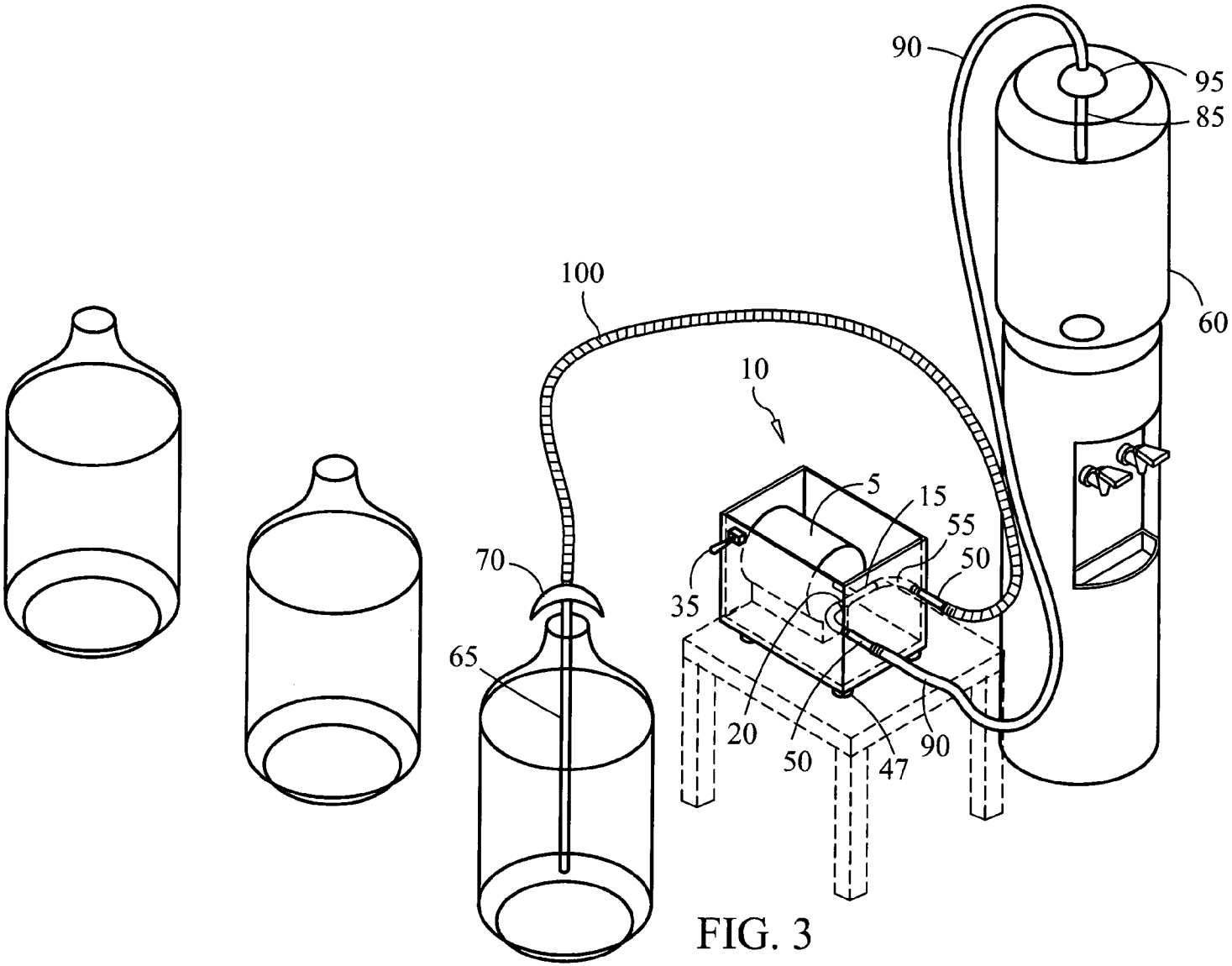
FIG. 3 is a front perspective view of the system of the present invention showing an alternative version with an expandable supply hose and with the pump positioned on a table (shown in phantom lines) between the water cooler and the supply bottle.

In an alternate version of the present invention, the supply hose 80 is replaced by an expandable supply hose 100, which is formed with a plurality of aligned and spaced apart rigid rings embedded in a flexible body having folds disposed in a one-to-one correspondence with the spaces between the rigid rings. The expandable supply hose 100 is shown in FIG. 3 and may be expanded in the manner of a conventional vacuum cleaner hose to reach a water supply bottle at a more distant location.

The expandable supply hose 100 allows a number of water supply bottles to be tapped by the system of the present invention without the need for shuffling the positions of the bottles.

The supply tube 65 and the filler tube 85 are preferably provided with a plurality of spaced apart lateral ridges encircling the proximal ends, to improve frictional engagement with the supply hose 80 and the filler hose 90, respectively.

While the preferred embodiment of the present invention has been described herein, together with several contemplated variations, it may be understood and appreciated that other various modifications can be made in the invention and that the appended claims are intended to cover all such modifications which fall within the spirit and scope of the invention disclosed and claimed herein.

What is claimed is:

1. A water cooler replenishing system for replenishing a freestanding water cooler from a conventional water supply bottle, comprising:

a fluid pump, an inlet port and an outlet port;

said inlet port and said outlet port being operatively connected in fluid communication with said pump;

said pump having selective energizing means for urging water inward from said inlet port and outward through said outlet port;

a water container having a top portion and a bottom portion, said top portion having a first opening, for feeding water to said water cooler;

said bottom portion having a second opening for receiving water into said container;

water collecting means disposed within said water supply bottle;

said water collecting means comprising a supply tube having proximal and distal ends, the distal end being sized to pass into said conventional water supply bottle, for collecting fluid therefrom;

said supply tube having first stop means, designed to prevent contact between the distal end of said supply tube and the bottom of said water supply bottle;

a watertight fluid conduit from said water collecting means to said inlet port;

water dispensing means directed through said second opening;

said water dispensing means comprising a filler tube having proximal and distal ends, the distal end being sized to pass through said second opening for delivering fluid into said water container;

said filler tube having second stop means, designed to prevent passage of said proximal end through said second opening;

a watertight fluid conduit from said outlet port to said fluid dispensing means;

whereby said water container may be inverted on said water cooler and said pump may be energized to collect water from said conventional water supply bottle and deliver water to said water container for replenishing said freestanding water cooler.

2. A water cooler replenishing system for replenishing a freestanding water cooler from a conventional water supply bottle, comprising:

a fluid pump, an inlet port and an outlet port;

said inlet port and said outlet port being operatively connected in fluid communication with said pump;

said pump having selective energizing means for urging water inward from said inlet port and outward through said outlet port;

a water container having a top portion and a bottom portion, said top portion having a first opening, for feeding water to said water cooler;

said bottom portion having a second opening for receiving water into said container;

water collecting means disposed within said water supply bottle;

said water collecting means comprising a supply tube having proximal and distal ends, the distal end being sized to pass into said conventional water supply bottle, for collecting fluid therefrom;

said supply tube having first stop means, designed to prevent contact between the distal end of said supply tube and the bottom of said water supply bottle;

said first stop means comprising a first transverse collar disposed at an intermediate position, along the length of said supply tube;

a watertight fluid conduit from said water collecting means to said inlet port;

water dispensing means directed through said second opening;

said water dispensing means comprising a filler tube having proximal and distal ends, the distal end being sized to pass through said second opening for delivering fluid into said water container;

said filler tube having second stop means, designed to prevent passage of said proximal end through said second opening;

said second stop means comprising a second transverse collar disposed at an intermediate position, along the length of said filler tube;

a watertight fluid conduit from said outlet port to said fluid dispensing means;

whereby said water container may be inverted on said water cooler and said pump may be energized to collect water from said conventional water supply bottle and deliver water to said water container for replenishing said freestanding water cooler.

3. A water cooler replenishing system for replenishing a freestanding water cooler from a conventional water supply bottle, comprising:

a fluid pump, an inlet port and an outlet port;

said inlet port and said outlet port being operatively connected in fluid communication with said pump;

said pump having selective energizing means for urging water inward from said inlet port and outward through said outlet port;

a water container having a top portion and a bottom portion, said top portion having a first opening, for feeding water to said water cooler;

said bottom portion having a second opening for receiving water into said container;

water collecting means disposed within said water supply bottle;

said water collecting means comprising a supply tube having proximal and distal ends, the distal end being sized to pass into said conventional water supply bottle, for collecting fluid therefrom;

said supply tube having first stop means, designed to prevent contact between the distal end of said supply tube and the bottom of said water supply bottle;

said first stop means comprising an adjustable collar having a central aperture for slideably disposing said adjustable collar on said supply tube for providing infinite adjustment of position;

a watertight fluid conduit from said water collecting means to said inlet port;

water dispensing means directed through said second opening;

said water dispensing means comprising a filler tube having proximal and distal ends, the distal end being sized to pass through said second opening for delivering fluid into said water container;

said filler tube having second stop means, designed to prevent passage of said proximal end through said second opening;

a watertight fluid conduit from said outlet port to said fluid dispensing means;

whereby said water container may be inverted on said water cooler and said pump may be energized to collect water from said conventional water supply bottle and deliver water to said water container for replenishing said freestanding water cooler.

4. A process for replenishing a free standing water cooler from a conventional water supply bottle comprising the steps of:

providing a fluid pump with an inlet port and an outlet port;

providing operative connection and fluid communication between said inlet port and said pump and between said pump and said outlet port;

providing selective means for energizing said pump;

providing a water container having a top portion and a bottom portion;

providing a first opening in said top portion, for feeding water to said water cooler and a second opening in said bottom portion, for receiving water;

inverting said water container and placing said water container on said conventional water cooler;

providing water collecting means disposed within said water supply bottle;

the step of providing said water collecting means comprises, providing a water supply tube having proximal and distal ends, and providing first stop means disposed on said water supply tube;

said step of providing first stop means comprises providing a first transverse collar disposed proximate to the proximal end of said supply tube, for preventing contact between the distal end of the supply tube and the bottom of the water container;

providing a watertight fluid conduit from said water collecting means to said inlet port;

providing water dispensing means directed through said second opening;

the step of providing water dispensing means comprises providing a filler tube and providing second stop means on said filler tube;

the step of providing second stop means comprises providing a second transverse collar disposed at an intermediate position along the length of said filler tube;

providing a watertight fluid conduit from said outlet port to said fluid dispensing means;

energizing said pump for collecting water from said conventional water supply bottle and dispensing water into said water container for replenishing said freestanding water cooler.

* * * * *